United States Patent [19]

Fatool

[11] Patent Number: 4,529,199

[45] Date of Patent: Jul. 16, 1985

[54] SAFETY BASE

[75] Inventor: Francis N. Fatool, Sunbury, Pa.

[73] Assignee: J. D. & C., Inc., Sunbury, Pa.

[21] Appl. No.: 592,061

[22] Filed: Mar. 22, 1984

[51] Int. Cl.[3] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 1,244,044 | 10/1917 | Falconer | 273/25 |
| 2,084,775 | 6/1937 | Orefice | 273/25 |
| 2,122,266 | 6/1938 | Seys | 273/25 |
| 2,405,492 | 8/1946 | Corbett | 273/25 |
| 2,695,784 | 11/1954 | Orsatti et al. | 273/25 |
| 3,122,684 | 2/1964 | Genin | 273/239 X |
| 3,862,756 | 1/1975 | Selliken | 273/25 |
| 3,971,558 | 7/1976 | Gardetto | 273/25 |
| 4,266,768 | 5/1981 | Hall | 273/25 |
| 4,398,714 | 8/1983 | Fuller et al. | 273/25 |

OTHER PUBLICATIONS

Pp. 49 and 71, Softball Insight, Feb. 1984.

J.D.C., Inc. Flyer, "Soft Touch", 2nd E. Reagan Sts., Sunbury, Pa. 17801.

*Primary Examiner*—Harland S. Skogquist

*Attorney, Agent, or Firm*—Thomas Hooker

[57] ABSTRACT

A breakaway safety base including a ground support and base which may be secured on a playing field in two positions for safe play by both young and old players. In the first position relative low sliding forces break the base away from the ground support while in the second position relatively greater sliding forces are required to break the base away from the ground support.

14 Claims, 6 Drawing Figures

SAFETY BASE

Figure 1:
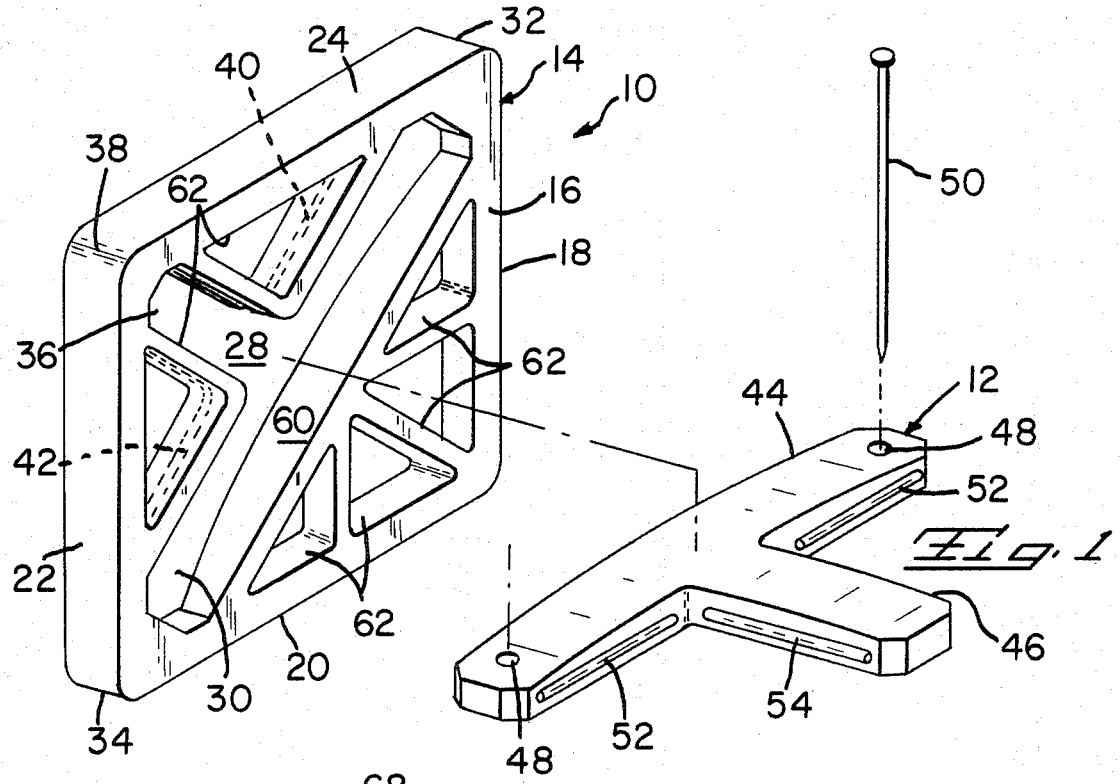

The invention relates to a safety base useful in playing softball, baseball or other games where players sliding into bases risk injury.

Breakaway safety bases are well known. In these bases, the breakaway characteristics are the same without regard to the direction force is applied to the base. While breakaway bases are improvements over conventional bases which are securely mounted to the playing field, they are unsuited for use by different ability players with different safety needs. For instance, a breakaway base suitable for adult play would be of no use in Little League or Pee Wee play because the breakaway threshold would be too high and players sliding roughly into the base would risk injury. Conversely, a breakaway base designed to prevent injury for younger players would be unsuitable for use by older, skilled players. This base would breakaway unduly easily thereby unnecessarily impeding play.

The breakaway safety base of the present invention includes a ground support which is secured to the playing field and a base which snaps over the ground support so that the two form a unitary safety base. The base may be secured to the field in two positions, depending upon the safety needs of the players. In the first position for young and inexperienced players, relatively light sliding contact between a player and the base deforms the base for ready breakaway from the ground support to reduce injury. When the game is played by older and more experienced players, the base is mounted on the playing field in a different position such that the connection between the base and the ground support is more secure and a higher loading force is required to break the base away from the ground support. When mounted in this position, the base is retained on the ground support despite the more active play, yet breaks away when subjected to loading forces sufficiently high to risk injuring the player sliding into the base.

Other objects and features of the invention will become apparent as the description proceeds, especially when taken in conjunction with the accompanying drawings illustrating the invention, of which there is one sheet and one embodiment.

IN THE DRAWINGS

Figure 2:
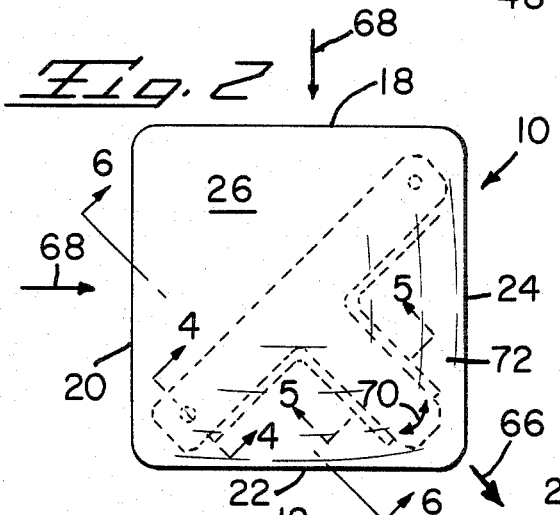
Figure 3:
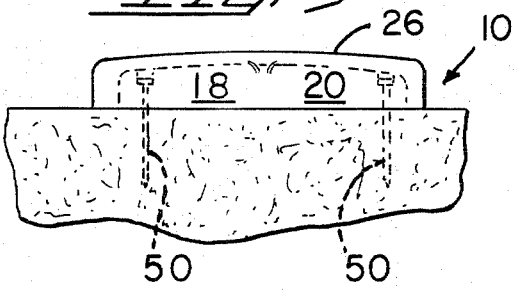
Figure 4:
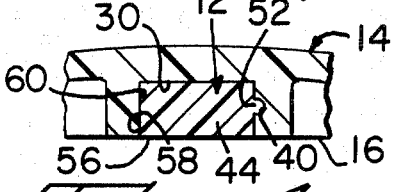
Figure 6:
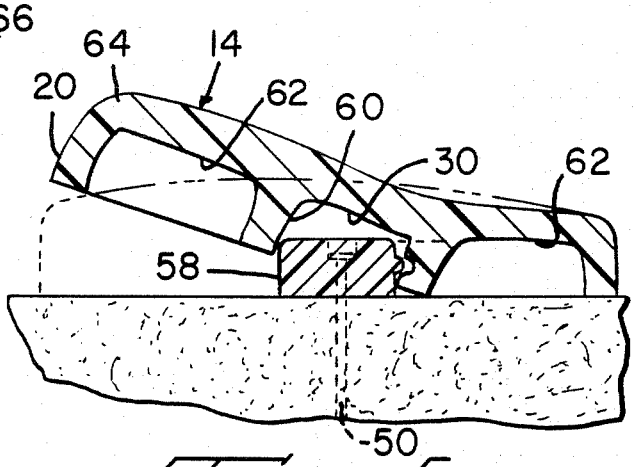
Figure 5:
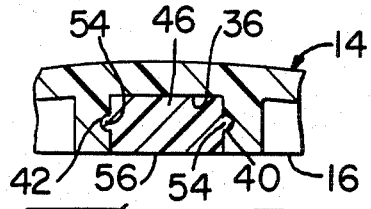

FIG. 1 is a perspective view illustrating a ground support and the underside of a base according to the invention;

FIGS. 2 and 3 are top and side views respectively of the safety base; and FIGS. 4, 5 and 6 are sectional views taken along lines 4—4, 5—5 and 6—6 respectively of FIG. 2.

Safety base 10 includes a T-shaped ground support 12 and a base 14 which is mounted on the ground support. The base includes a flat lower surface 16 adapted to rest on a baseball playing field, side walls 18, 20, 22 and 24 and a slightly domed upper surface 26. The base and ground support are formed from a stiffly resilient material such as polyvinyl cloride, polypropylene or polyurethane with wear-resistant exterior surfaces. The members are preferably manufactured by a molding operation.

A T-shaped recess 28 for support 12 is formed in the ground surface 16 of base 14 and includes a straight recess 30 at the head of the T extending diagonally between base corners 32 and 34 defined by the intersections of sides 18 and 24 and 20 and 22 respectively. The recess 28 includes a short diagonal recess 36 at the leg of the T extending from the center of recess 30 diagonally toward corner 38 at the intersection of base sides 22 and 24. Lock grooves 40 and 42 are formed in and extend along the opposite side walls of recess 36, around the interior corners at the intersections with recess 30 and then along the adjacent side wall of recess 30 toward base corners 32 and 34. The grooves are located at a constant distance above the ground surface 16. The base 14 is domed and, as illustrated in FIGS. 4, 5 and 6, has a constant thickness above recess 28.

The ground support 12 is T-shaped and includes a relatively long, straight head 44 and a leg 46 extending perpendicularly away from the center of head 44. Recessed bores 48 extend through the ends of head 44. The ground support 12 is secured flush on the playing field in a desired location by means of spikes 50 which are driven into the ground through bores 48 so that the heads of the spikes engage the bores and hold the support in place. Only one spike is shown in FIG. 1.

Lock ridges 52 extend along the side wall of head 44 adjacent the leg 46. Lock ridges 54 extend along both sidewalls of the leg 46. The ridges 52 and 54 project outwardly from the vertical sides of the ground support and extend parallel to the flat bottom ground surface 56 of the support. The ridges 52 and 54 are separate and do not extend around the corners joining the sides of the head 44 and leg 46, as illustrated most clearly in FIG. 1.

The ground support 12 fits snugly within the T-shaped recess 28 of base 14 with domed head 44 fitted within diagonal head recess 30 and domed leg 46 fitted snugly within the short leg recess 36. When in this position the ridges 52 and 54 extend into the continuous grooves 40 and 42 and the lower surface 56 of the ground mount is flush with the base lower surface 16. The smooth side wall 58 of head 44 away from leg 46 rests flush upon the smooth sidewall 60 of recess 30 away from recess 36.

As shown in FIG. 1, a number of recesses 62 are provided in surface 16. These recesses serve to lighten the base and form no part of the invention. If desired, recesses may be provided in the undersurface of the ground support 12.

In playing the game of baseball first, second and third bases are secured to the playing field with two adjacent sides facing the base paths and the other two adjacent sides facing outwardly of the base paths. Runners contact the sides of the base facing the base paths. The breakaway properties of the safety base 10 permit the base to be mounted on the playing field in either of two positions so that either sides 18 and 20 face the base paths or sides 22 and 24 face the base paths. The base mounting position for a given game of baseball is determined by the desired breakaway properties of the base.

In games of baseball or softball played by young and relatively inexperienced players it is desirable that bases breakaway from the ground support relatively easily to prevent injury. In this case, the safety base 10 is mounted on the playing field with base sides 18 and 20 facing the base paths. When the game is played by relatively experienced, older players who are physically fit and less likely to injure themselves running the bases, the safety base 10 is mounted on the playing field with sides 22 and 24 facing the base paths. The mounting of the base on the base paths and the breakaway characteristics of the base will now be described.

When base 10 is mounted on the field for play by young or inexperienced players the ground support 12 is positioned at the base location with the leg 46 extending away from the pitcher's mound. When so positioned, the ground support is secured in place by driving spikes 50 into the ground so that the heads of the spikes seat within the recesses of bores 48. Once the ground support is secured, the base 14 is positioned above and then pushed down onto the support so that the support is fitted snugly within and fills the T-shaped recess 28 as shown in FIGS. 2, 4 and 5. The lock ridges 52 and 54 fit into the grooves 40 and 42, the top of the base rests on the support and the surfaces 58 and 60 are flush upon each other. The ground support has a snug tight fit within the recess to assure the base is held firmly in place on the field. When mounted, base sidewalls 18 and 20 face the base paths leading away from the base for contact by base runners.

FIG. 6 illustrates deformation of the base 14 by a player sliding into sidewall 20. Similar deformation and breakaway occurs when a player slides into sidewall 18. Impact with the base lifts the forward unsupported portion 64 of base 14 adjacent sides 18 and 20 as in FIG. 6 so that the portion is moved above ground support sidewall 58 and the base slides free of the ground support. Recesses 62 are relatively small and do not allow the support to fall back into the base. In this way, the possibility of injury to the player sliding into the base is reduced.

During breakaway of the base from the ground support the base moves in a direction indicated by arrow 66 in FIG. 2 parallel to the longitudinal axis of leg 46. Grooves 40 move perpendicularly away from ridges 54 and the grooves 40 and 42 slide along the ridges 54 on the leg 46 without impeding breakaway. The break in the ridges 52 and 54 at the corners between the leg 46 and head 44 prevent possible hangup of the base on the ground support as the forward portion is bent up and passes over the support.

Players sliding into the safety base 10 are likely to strike sides 18 or 20 in directions approximately perpendicular to the sides as indicated by arrows 68. The force deforms and lifts the forward base portion 64. The component of the force parallel to the longitudinal axis of leg 46 slides the lifted base away from ground support for effective, safe breakaway. The components of force acting on the base in a direction perpendicular to the longitudinal axis of leg 46 may rotate the leg away from the side of the base contacted by the player during breakaway thereby cooperating with the deformed base to absorb energy during contact and reduce the liklihood of injury. The free, unspiked leg 46 may be flexed in either direction indicated by arrow 70, depending upon whether breakaway contact is made with base side 18 or 20.

The breakaway characteristics of safety base 10 are designed to assure that the base remains mounted on the ground support when players contact the base with relatively low forces unlikely to result in injury. Following breakaway, base 14 is easily remounted on ground support 12 in the manner previously described.

When the safety base is used in a game played by experienced players, the ground support is positioned on the playing field with leg 46 extending toward the pitcher's mound. In this case, base sidewalls 22 and 24 face the base paths for contact by base runners. Runners sliding into sidewalls 22 and 24 deform the base and subject it to lifting forces which tend to disengage the base from the ground support. The groove and recess connections between the base and leg 46 and the head 44 at ridges 52 and 54 resist disengagement, thereby assuring that the base is retained on the ground support when subjected to sliding forces appreciably greater than the sliding forces which striking sides 18 and 20 would free the base from the ground support.

In the event a player slides into side 22 or 24 with a force sufficiently high to risk injury, the deformation and lift of the base 10 snaps the grooves 40 and 42 up past ridges 52 and 54 and allows the adjacent supported portion 72 of the base to rise above the ground support and the base to slide free of the ground support. The force contacting side 22 or 24 for breakaway is appreciably greater than the force contacting sides 18 and 20 for breakaway. After breakaway, the base 14 is easily snapped back onto the ground support for continuation of the game.

When the ground support 14 is fitted within recess 28 each side of head 44 frictionally engages the adjacent side of straight recess 30. The frictional connection and interlocking groove and the ridge connection 40, 52 on one side of the head cooperate to form a relatively strong breakaway connection. This breakaway connection is stronger than the frictional breakaway connection between flat surfaces 58 and 60 on the other side of the head. The greater resistance to breakaway on one side of the ground support head enables the base to be used for both young and older players by mounting the ground support in either of the two positions as previously described.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim my invention is:

1. A breakaway safety base including a base; a ground support; and means for securing the ground support to a playing field, the base being formed from a resilient material and including a ground surface, four sides intersecting at corners and an elongate recess formed in the ground surface and extending between opposed corners of the base, the ground support including an elongate head fitted snugly within the elongate recess, a first breakaway connection between one side of the ground support and the base and a second breakaway connection stronger than the first breakaway connection between the other side of the ground support and the base, whereby players sliding into a side of the base adjacent said one side of the ground support break away the base from the ground support more easily than players sliding into a side of the base adjacent the other side of the ground support.

2. A breakaway safety base as in claim 1 wherein the second breakaway connection includes a member extending outwardly of the ground support and into a recess in the base.

3. A breakaway safety base as in claim 1 wherein said second breakaway connection includes a ridge and slot connection extending along the length of the ground support.

4. A breakaway safety base as in claim 3 wherein both said connections include surface-to-surface frictional connections.

5. A breakaway safety base as in claim 1 wherein the base includes a T-shaped recess formed in the ground surface, the elongate recess forming the head of the T, and a leg recess extending perpendicularly from the elongate recess toward one corner of the base, the ground support is formed from a resilient material and is T-shaped, the head extending across the top of the T, and includes a leg extending perpendicularly away from the other side of the head, the leg being fitted snugly within the leg portion of the recess.

6. A breakaway safety base as in claim 5 wherein said second connection includes a ridge and slot connection extending along the length of the ground support head.

7. A breakaway safety base as in claim 6 including ridge and slot connections between the base and both sides of the ground support leg.

8. A breakaway safety base as in claim 7 wherein the ground support includes outwardly projecting ridges extending along the length of the head on either side of the ground support leg, ridges extending along the length of both sides of the leg and the base including a plurality of recesses extending along the sides of the leg recess and along part of the length of one side of the elongate recess, said ridges being seated within said recesses for breakaway.

9. A breakaway safety base including a base, a ground support, and means for securing the ground support to a playing field, the base and ground support being formed from a resilient material, the base including a ground surface, four sides intersecting at corners and a T-shaped recess formed in the ground surface, the recess including an elongate head recess extending between opposite corners of the base and a leg recess extending perpendicularly away from the head recess toward another corner of the base, the ground support being T-shaped and including an elongate head and a leg extending perpendicularly away from the center of the head, said ground support being fitted snugly within the T-shaped recess in the base with the head fitted within the head recess and the leg fitted within the leg recess, a frictional connection between the side of the ground support head away from the leg and the base, a frictional connection between the other side of the ground support head and the base, and an additional breakaway resistant connection between the other side of the ground support head and the base whereby players sliding into a side of the base adjacent said one side of the ground support head break the base away from the ground support more easily than players sliding into a side of the base adjacent the other side of the ground support head.

10. A breakaway safety base as in claim 9 including a further breakaway resistant connection between the ground support leg and the base.

11. A breakaway safety base as in claim 10 wherein said breakaway resistant connections include interfitting members.

12. A breakaway safety base as in claim 10 wherein said breakaway resistant connections are of the ridge and slot type, such connections extending along the interfaces between the base and ground support.

13. A breakaway safety base as in claim 12 wherein said connections are discontinous at the corners where the ground support leg joins the ground support head.

14. A breakaway safety base as in claim 13 including a plurality of recesses formed in the ground surface away from the T-shaped recess.

* * * * *